US009938700B2

(12) United States Patent
Shaw et al.

(10) Patent No.: US 9,938,700 B2
(45) Date of Patent: Apr. 10, 2018

(54) COLD WATER DELIVERY SYSTEM

(71) Applicant: Elkay Manufacturing Company, Oak Brook, IL (US)

(72) Inventors: Damon D. Shaw, Stillman Valley, IL (US); Franco Savoni, Geneva, IL (US); Russ Hansen, Mount Carroll, IL (US); Evan A. Fulford, Chicago, IL (US); Joel E. Leiser, Freeport, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 1267 days.

(21) Appl. No.: 13/973,610

(22) Filed: Aug. 22, 2013

(65) Prior Publication Data

US 2014/0053911 A1 Feb. 27, 2014

Related U.S. Application Data

(60) Provisional application No. 61/692,589, filed on Aug. 23, 2012.

(51) Int. Cl.
*E03C 1/02* (2006.01)
*B67D 3/00* (2006.01)
(Continued)

(52) U.S. Cl.
CPC ..... *E03C 1/02* (2013.01); *B67D 1/0014* (2013.01); *B67D 1/0043* (2013.01);
(Continued)

(58) Field of Classification Search
CPC .. B67D 1/0014; B67D 1/0052; B67D 1/0884; B67D 2007/0451; B67D 2210/0451;
(Continued)

(56) References Cited

U.S. PATENT DOCUMENTS

RE20,558 E 11/1937 Candor
2,529,781 A 11/1950 Morrison
(Continued)

FOREIGN PATENT DOCUMENTS

EP 2 447 641 A2 5/2012
WO WO 2011/120085 A1 3/2011

OTHER PUBLICATIONS

European Patent Application No. 13831482.8 Search Report (dated May 19, 2016).
(Continued)

*Primary Examiner* — Jianying Atkisson
*Assistant Examiner* — Meraj A Shaikh
(74) *Attorney, Agent, or Firm* — Leydig, Voit & Mayer, Ltd.

(57) ABSTRACT

A cold water delivery system is described that can consistently provide cold water at a desired temperature over repetitive and large draws from the outlet of the system. The cold water system can provide multiple pathways for the water to travel from a source, or inlet, to the outlet. A cooling system can be provided that cools a plurality of reservoirs of water. The reservoirs can maintain cold water at different temperatures. A control system controls the cooling system to maintain the temperature of the water in the reservoirs. The control system can also control one or more mixing valves to determine the volume of water from each of the reservoirs and the water inlet that reaches the outlet.

28 Claims, 4 Drawing Sheets

(51) Int. Cl.
*B67D 1/00* (2006.01)
*B67D 1/08* (2006.01)

(52) U.S. Cl.
CPC ..... *B67D 1/0857* (2013.01); *B67D 1/0884* (2013.01); *B67D 3/0009* (2013.01); *B67D 3/0012* (2013.01); *B67D 3/0016* (2013.01); *B67D 3/0038* (2013.01); *Y10T 137/0329* (2015.04); *Y10T 137/86815* (2015.04)

(58) Field of Classification Search
CPC .. B67D 1/0043; B67D 3/0016; B67D 3/0012; B67D 3/0009; B67D 3/0038; G05D 23/13; G05D 23/1306; G05D 23/132; G05D 23/134
USPC ..... 222/146.6, 146.1, 54, 145.5, 145.6
See application file for complete search history.

(56) References Cited

U.S. PATENT DOCUMENTS 2,980,140 A * 4/1961 McMillan ..... F16K 11/10 137/607
3,605,783 A 9/1971 Pecker et al.
3,739,842 A 6/1973 Whalen
3,882,693 A 5/1975 Hiller
4,241,868 A 12/1980 Perkins
4,322,031 A 3/1982 Gehlert
4,541,562 A 9/1985 Zukausky
4,558,817 A 12/1985 Kiendl
4,611,757 A 9/1986 Saether
4,618,091 A 10/1986 Buzzi
4,700,884 A * 10/1987 Barrett ..... E03B 7/04 126/362.1
4,753,370 A * 6/1988 Rudick ..... B67D 1/0051 222/105
4,792,059 A 12/1988 Kerner et al.
4,842,191 A 6/1989 Bergmann
4,854,498 A 8/1989 Stayton
4,870,986 A 10/1989 Barrett et al.
4,875,623 A 10/1989 Garris
4,923,116 A 5/1990 Homan
4,965,894 A 10/1990 Baus
5,032,992 A 7/1991 Bergmann
5,174,495 A 12/1992 Eichholz et al.
5,390,690 A 2/1995 Blaga
5,493,873 A 2/1996 Donselman et al.
5,501,077 A 3/1996 Davis et al.
5,577,393 A 11/1996 Donselman et al.
5,701,387 A 12/1997 McGugan
5,829,475 A 11/1998 Acker
5,860,471 A 1/1999 Perryment et al.
5,980,561 A 11/1999 Kolen et al.
6,207,046 B1 * 3/2001 Yamashita ..... B67D 1/07 210/138
6,250,558 B1 6/2001 Dogre Cuevas
6,460,735 B1 10/2002 Greenwald et al.
6,629,645 B2 10/2003 Mountford et al.
6,634,048 B1 10/2003 Hornung et al.
6,676,024 B1 1/2004 McNerney et al.
6,912,867 B2 7/2005 Busick
6,913,203 B2 7/2005 DeLangis
7,040,542 B2 5/2006 Hugger
7,240,850 B2 7/2007 Beck et al.
7,287,392 B2 10/2007 Brand et al.
7,857,234 B2 12/2010 Daley et al.
7,889,187 B2 2/2011 Freier et al.
8,038,355 B2 10/2011 Hashiguchi
8,043,556 B2 10/2011 Peel et al.
8,991,652 B2 * 3/2015 Harrod ..... B67D 3/0009 222/144.5
2002/0020179 A1 * 2/2002 Winkler ..... F25D 17/02 62/177
2005/0161086 A1 7/2005 Kubik
2005/0279689 A1 * 12/2005 Oranski ..... B67D 1/001 210/198.1
2007/0170270 A1 7/2007 Jelinek et al.
2007/0170273 A1 7/2007 McIllwain
2007/0267441 A1 * 11/2007 van Opstal ..... B67D 1/0025 222/129.4
2008/0014064 A1 * 1/2008 Dixon ..... B67D 1/0802 414/419
2009/0159611 A1 6/2009 Roetker et al.
2010/0294804 A1 * 11/2010 Dalchau ..... B67D 1/0014 222/146.1
2011/0098793 A1 4/2011 Lowe et al.
2012/0104021 A1 * 5/2012 Cur ..... F25D 23/126 62/389
2013/0015208 A1 * 1/2013 Harrod ..... B67D 3/0009 222/145.5

OTHER PUBLICATIONS

International Patent Application No. PCT/US2013/056210, Search Report (dated Jan. 24, 2014).

* cited by examiner

COLD WATER DELIVERY SYSTEM

CROSS-REFERENCE TO RELATED APPLICATION

This patent application claims the benefit of U.S. Provisional Patent Application No. 61/692,589, filed Aug. 23, 2012, which is incorporated by reference in its entirety herein.

BACKGROUND

Cold water delivery systems are often incorporated into beverage dispensers, such as bottle-type water coolers, drinking fountains, bottle filling water stations, and refrigerator water dispensers, in order to cool incoming water to a desired drinking temperature prior to dispensing to a user. These systems utilize a water tank and refrigeration unit. The flow path of the water typically follows a single flow path. The water enters the system from a tap or a large bottle, and tubing carries the water to the water tank, which is cooled by the refrigeration unit. The water tank serves as a reservoir to provide a supply of cold water through further tubing to an outlet where the cold water is dispensed.

In systems where water draws from the outlet are frequent and/or relatively large, the system may have difficulty maintaining a desirable output temperature of the water. For example, such difficulties may be encountered in areas with high volume consumption due to repeated, large draws, such as in fitness centers. In addition, with consumers looking to decrease the use of disposable plastic water bottles, consumers have increased their usage of reusable water bottles. Reusable water bottles typically have a volume of sixteen ounces or greater, and many current cold water systems are unable to maintain a desired temperature when providing large draws to fill these bottles.

BRIEF SUMMARY

A cold water delivery system is described that can consistently provide cold water at a desired temperature over repetitive and large draws from the outlet by a consumer. The cold water system can provide multiple pathways for the water to travel from an inlet, or source, to an outlet. A cooling system can be provided that cools a plurality of reservoirs of water. The reservoirs can maintain cold water at different temperatures. Temperature sensors can be disposed in the system to monitor water temperature at desired positions in the system. A control system controls the cooling system to maintain the temperature of the water in the reservoirs. The control system can also control one or more mixing valves to determine the volume of water from each of the reservoirs and the water inlet that can be combined upstream of the outlet. The cold water delivery system can be incorporated into a suitable apparatus for dispensing water such as a bottle-type water cooler, a drinking fountain, a bottle filling water station, or a refrigerator water dispenser. A method of dispensing cold water is also described.

A cold water delivery system comprises an inlet for receiving water at a first temperature, an outlet for dispensing water, and a first reservoir fluidly connected to the inlet and the outlet. The first reservoir may receive water from the inlet and maintain the water received therein from the inlet at a second temperature that is lower than the first temperature. The system may further include a second reservoir fluidly connected to the inlet and the outlet. The second reservoir may maintain the water received therein at a third temperature that is lower than the second temperature. A mixing valve may be fluidly connected to the outlet. The mixing valve may receive water from the first reservoir and water from the inlet at the first temperature, and further receive water from the second reservoir when the water dispensed from the outlet rises above a predetermined threshold temperature. The mixing valve proportions the water dispensed from the outlet from amongst the water received from the first reservoir, the second reservoir, and the inlet at the first temperature to maintain the water dispensed from the outlet at or below the predetermined threshold temperature.

A method of dispensing cold water comprises receiving water at a first temperature from an inlet and directing water from the inlet to a first reservoir fluidly connected to both the inlet and an outlet for dispensing water. The water in the first reservoir may be cooled to a second temperature that is lower than the first temperature. The method further comprises directing water to a second reservoir fluidly connected to the inlet and the outlet, and cooling the water in the second reservoir to a third temperature that is lower than the second temperature. The water from the first reservoir and the inlet at the first temperature may be directed to the outlet. The water from the second reservoir may be directed to the outlet when water dispensed from the outlet rises above a predetermined threshold temperature. The water dispensed from the outlet may be proportioned from amongst the water received from the first reservoir, the second reservoir, and the inlet at the first temperature to maintain the water dispensed from the outlet at or below the predetermined threshold temperature.

DETAILED DESCRIPTION

Figure 1:
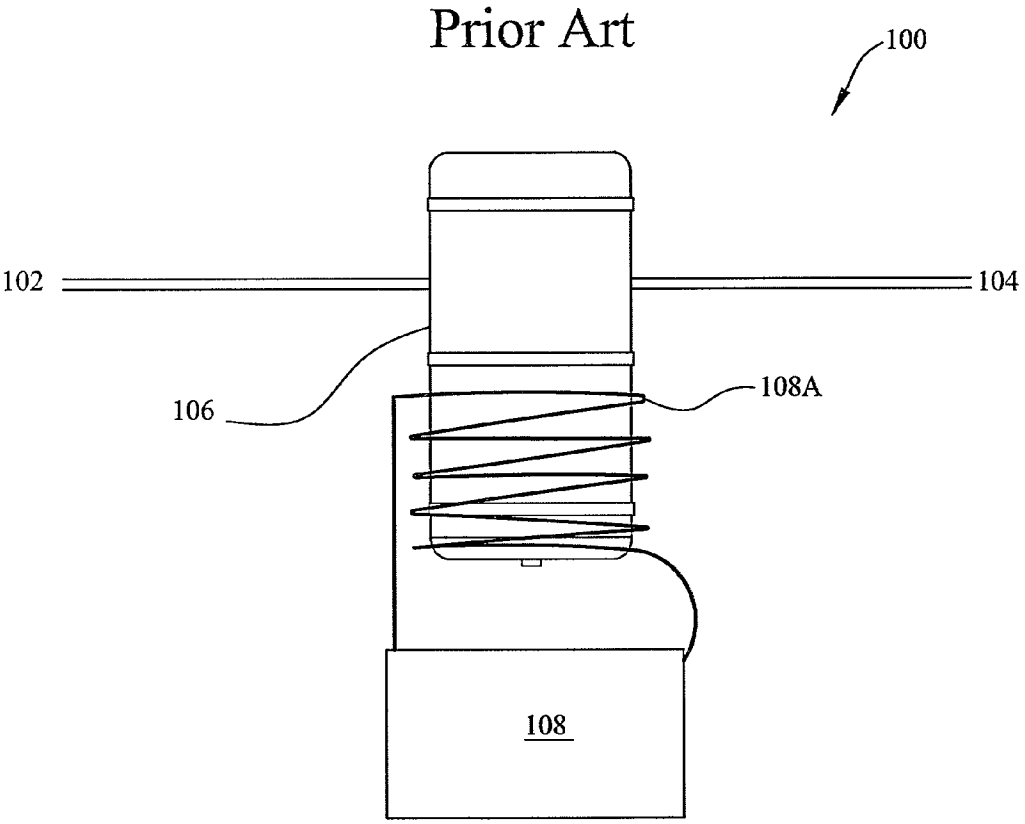
FIG. 1 is a diagrammatic view of a prior art cold water system.

FIG. 1 shows a prior art cold water delivery system 100 including a water inlet 102, a water outlet 104, a water tank 106, and a cooling system 108. The water enters the water inlet 102 and fills the water tank 106. The cooling system 108 provides a refrigerant, usually through copper tubing 108A coiled around the tank 106, which cools the tank 106 and the water therein. When a user actuates a valve near the outlet 104, cold water flows from the tank 106 and is dispensed at the outlet 104. As water is drawn out of the tank 106, it is replaced with warmer water from the water inlet 102, which raises the temperature of the water in the tank 106. In response, the cooling system 108 is activated to reduce the temperature of the water in the tank 106.

Figure 2:
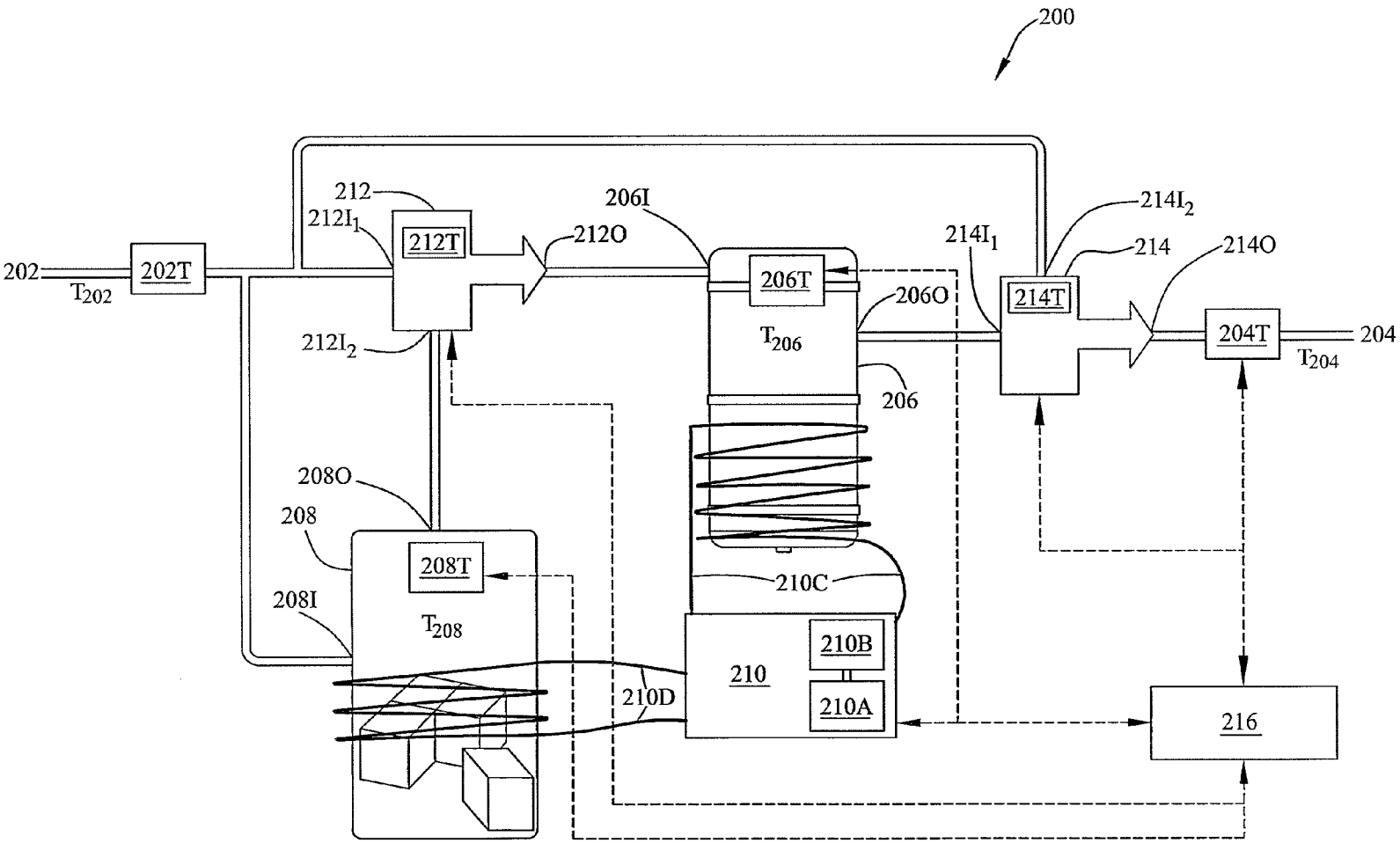
FIG. 2 is a diagrammatic view of a first embodiment of a cold water delivery system according to the disclosure.

FIG. 2 shows a cold water delivery system 200 having multiple water reservoirs and multiple flow paths for water to travel between an inlet 202 and an outlet 204. The multiple reservoirs and flow paths cooperate to maintain a steady supply of cold water within a desired drinking temperature range over repeated and large draws of water from the system 200. One of the reservoirs can be a cold tank 206, and another reservoir can be an ice booster reservoir 208. A cooling system 210 can be used to reduce the temperature of the water in the reservoirs 206, 208. Mixing valves 212, 214 can be used to adjust the flow and proportion of water from each of the reservoirs 206, 208 and the water inlet 202 that is dispensed at the outlet 204. A control system 216 can be used to open and close the mixing valves 212, 214; the control system 216 can also control the cooling system 210. The control system 216 may utilize various input devices to control the cold water delivery system 200 and one or more sensors to provide data and input signals representative of various operating parameters of the cold water delivery system 200 and the environment in which it is located. For example, temperature sensors 202T, 204T, 206T, 208T, 212T, 214T can be disposed in the system 200 to monitor water temperature at inlet 202, outlet 204, in cold tank 206, in ice booster reservoir 208, and at mixing valves 212, 214, respectively, and to provide feedback to the control system 216. The control system 216 can also receive input from an actuator used to dispense water from the cold water delivery system 200. A user triggers the actuator to obtain cold water from the cold water delivery system 200.

In FIG. 2, the control system 216 is shown generally by dashed lines, which indicate associations between the control system 216 and the components of the cold water delivery system 200. The control system 216 may include an electronic control module or controller and a plurality of sensors, such as temperature sensors 202T, 204T, 206T, 208T, 212T, 214T associated with the cold water delivery system 200. The control system 216 may be an electronic controller that operates in a logical fashion to perform operations, execute control algorithms, store and retrieve data, and execute other desired operations. The control system 216 may include or access memory, secondary storage devices, processors, and any other components for running an application. The memory and secondary storage devices may be in the form of read-only memory (ROM) or random access memory (RAM) or integrated circuitry that is accessible by the control system 216. Various other circuits may be associated with the control system 216, such as power supply circuitry, signal conditioning circuitry, driver circuitry, and other types of circuitry.

The control system 216 may be a single controller or may include more than one controller disposed to control various functions and/or features of the cold water delivery system 200. The term "control system" is meant to be used in its broadest sense to include one or more controllers and/or microprocessors that may be associated with the cold water delivery system 200 and that may cooperate in controlling various functions and operations of the system 200. The functionality of the control system 216 may be implemented in hardware and/or software without regard to the functionality. The control system 216 may rely on one or more data maps relating to the operating conditions and the operating environment of the cold water delivery system 200 that may be stored in the memory of control system 216. Each of these data maps may include a collection of data in the form of tables, graphs, and/or equations.

The control system 216 may be located on the cold water delivery system 200 and may also include components located remotely from the cold water delivery system 200, such as at a command center. The functionality of the control system 216 may be distributed so that certain functions are performed at cold water delivery system 200 and other functions are performed remotely. In such case, the control system 216 may include a communications system such as wireless network system for transmitting signals between the cold water delivery system 200 and a system located remote from the cold water delivery system 200.

The water inlet 202 can be connected to a water source such as a water tap or a water bottle to provide water to the system 200. Depending on the source, the temperature $T_{202}$ of the incoming water is approximately at or below room temperature, e.g., about 70° F. The flowpaths in system 200 can be constructed with tubing, and can be arranged and connected in any suitable manner to deliver water from water inlet 202 to water outlet 204. The tubing can be made of any suitable material, such as copper.

The cold tank 206 can be a tank for storing water that is cooled to a temperature below room temperature. For example, the water can be cooled to a temperature below about 55° F. However, it will be appreciated that the cold tank 206 can be set to provide cold water at any suitable temperature. The cooling system 210 operates to maintain the cold tank 206 at approximately a desired temperature. The cooling system 210 can include tubing for carrying a refrigerant to the tank 206, and the tubing can be arranged in any suitable manner, such as coiled around or disposed in the cold tank 206. The refrigerant moves through the tubing to cool the tank 206 and the water therein. The cold tank 206 has an inlet 206I for receiving water and an outlet 206O for transferring water out of the tank 206. The cold tank 206 can be of any suitable shape and size. A temperature sensor 206T can be disposed on or within the cold tank 206 to monitor the temperature $T_{206}$ of the water therein.

The ice booster reservoir 208 can be a tank that is cooled to a temperature below the temperature $T_{206}$ of the cold tank 206. For example, the water in the ice booster reservoir 208 can be cooled to approximately at or above the freezing temperature of water, i.e., about or above 32° F. However, it will be appreciated that the ice booster reservoir 208 can be set to provide cold water at any suitable temperature, it being understood that ice can form in the ice booster reservoir 208. The cooling system 210 can include tubing for carrying a refrigerant to the ice booster reservoir 208, and can be arranged in any suitable manner, such as coiled around or disposed in the ice booster reservoir 208. The refrigerant moves through the tubing to cool the ice booster reservoir 208 and the water therein. The ice booster reservoir 208 has an inlet 208I for receiving water and an outlet 208O for transferring water out of the ice booster reservoir 208. The ice booster reservoir 208 can be of any suitable shape and size. A temperature sensor 208T can be disposed on or within the ice booster reservoir 208 to monitor the temperature $T_{208}$ of the water therein.

The mixing valves 212, 214 in the system 200 can include one or more inlet ports for receiving incoming water and an outlet port. The mixing valves 212, 214 can be on/off valves or can be variable valves such that they can be either partially or fully opened and closed. Mixing valve 212 can have a first inlet $212I_1$ for receiving water from inlet 202, a second inlet $212I_2$ for receiving water from ice booster reservoir 208, and an outlet 212O for dispensing water from mixing valve 212. Mixing valve 214 can have a first inlet $214I_1$ for receiving water from cold tank 206, a second inlet $214I_2$ for receiving water from inlet 202, and an outlet 214O for dispensing water from mixing valve 214. The mixing valves 212, 214 can be controlled by the control system 216. It will be appreciated that any suitable mixing valve can be used. The mixing valves 212, 214 can include temperature sensors 212T, 214T to monitor the temperature of water entering and/or exiting the valves 212, 214. In addition, the temperature $T_{202}$ of the water entering the cold water delivery system 200 can be monitored with a temperature sensor 202T. It will be appreciated that the system 200 can include any suitable number of temperature sensors disposed at any suitable position in the system 200.

The cooling system 210 can include a refrigeration unit having a compressor 210A, an expansion valve 210B, and copper tubing 210C, 210D for the passage of a refrigerant. After the compressor 210A compresses the refrigerant, the refrigerant passes through the expansion valve 210B to expand and lower the temperature of the refrigerant. Downstream of the expansion valve 210B, as mentioned above, tubing 210C, 210D carrying refrigerant may be used to cool the cold tank 206 and the ice booster reservoir 208, respectively. The tubing 210C, 210D may, for example, be coiled around the exterior or disposed within the interior of the cold tank 206 and the ice booster reservoir 208. The tubing 210C, 210D can be made of any suitable material, such as copper. The cold refrigerant moves through the tubing 210C, 210D to cool the cold tank 206 and the ice booster reservoir 208, and the water therein. A valve can be used to direct refrigerant to one or both of the cold tank 206 and ice booster reservoir 208, as needed.

As shown in FIG. 2, water at temperature $T_{202}$ can be provided to the cold water delivery system 200 from water inlet 202. The inlet water can enter port 212$I_1$ of a mixing valve 212 and exit port 212O of mixing valve 212 to enter the cold tank 206, where the temperature of the water can be reduced. The temperature $T_{206}$ of the water in the cold tank 206 is monitored by temperature sensor 206T. The temperature $T_{206}$ is communicated to the control system 216, which can activate the cooling system 210 to cool the cold tank 206 when the temperature $T_{206}$ in the cold tank 206 exceeds a predetermined threshold temperature $T_t$. Water can exit the cold tank 206 via port 206O and enter port 214$I_1$ of mixing valve 214 near the outlet 204 of the cold water delivery system 200.

Water flowing from the inlet 202 can also be directed to port 214$I_2$ of mixing valve 214. Using temperature measurements, the control system 216 can dynamically control the mixing valve 214 to ensure that the temperature $T_{204}$ of the water exiting the outlet 204 of the system 200 is at or near a desired drinking temperature $T_d$. For example, the control system 216 can adjust the valve 214 to proportion the water from ports 214$I_1$ and 214$I_2$ to provide water exiting the system 200 at port 214O at a temperature $T_{204}$ at or near the desired drinking temperature $T_d$.

The water coming in from the water inlet 202 can also be directed to port 208I of the ice booster reservoir 208, which can super cool the water to a temperature $T_{208}$ well below the temperature $T_{206}$ of the water in the cold tank 206. The temperature $T_{208}$ of the water in the ice booster reservoir 208 is monitored by temperature sensor 208T. The temperature sensor 208T communicates with the control system 216, which can activate the cooling system 210 to cool the ice booster reservoir 208 when the temperature $T_{206}$ in the cold tank 206 exceeds a predetermined threshold temperature $T_t$. It will be appreciated that the cooling system 210 can independently or simultaneously cool the cold tank 206 and ice booster reservoir 208. Water can exit the ice booster reservoir 208 via port 208O and enter port 212$I_2$ of mixing valve 212. The water from the ice booster reservoir 208 can then be mixed with water from inlet 202 entering mixing valve 212 via port 212$I_1$ before exiting via port 212O. Alternatively, port 212$I_1$ can be closed to pass only the water from the ice booster reservoir 208 out of port 212O and into the cold tank 206. In this manner the water from the ice booster reservoir 208 can be selectively provided to the cold tank 206 to recharge the cold tank 206 to keep up with demand for water within a desired temperature range at the outlet 204. It will be appreciated that the control system 216 can open and close, partially or fully, the ports in the mixing valves 212, 214 in any suitable manner to maintain a relatively steady output of cold water within a desired temperature range at the outlet 204 of the cold water delivery system 200.

In an exemplary scenario, the temperature $T_{202}$ of the water at inlet 202 can be approximately 70° F., the ambient temperature in which the cold water delivery system 200 is located can be approximately 75° F., and the predetermined threshold temperature $T_t$ can be 55° F. Control system 216 initially directs mixing valve 212 to open ports 212$I_1$ and 212O and to close port 212$I_2$. Cold tank 206 is then supplied with water of temperature $T_{202}$ from inlet 202, which it chills to a temperature $T_{206}$ and then provides to mixing valve 214 via port 206O. Control system 216 then directs mixing valve 214 to open ports 214$I_1$, 214$I_2$, and 214O, and water at temperature $T_{204}$ is then dispensed from the cold water delivery system 200. Initially, the temperature $T_{204}$ of the dispensed water is equal to or below the desired drinking temperature $T_d$. In this configuration, the cold water delivery system 200 outputs water received from both cold tank 206 and directly from inlet 202.

However, when the system 200 experiences frequent and/or relatively large water draws, the temperature $T_{206}$ of the water in cold tank 206 may rise above the predetermined threshold temperature $T_t$ (i.e., the temperature $T_{206}$ of the water in cold tank 206 may rise to, for example, 56° F. or higher). When the temperature $T_{206}$ of the water in cold tank 206 rises above the predetermined threshold temperature $T_t$, the temperature $T_{204}$ of the water dispensed from the cold water delivery system 200 may rise above the desired drinking temperature $T_d$. When this occurs, control system 216 directs mixing valve 212 to close port 212$I_1$ and to open port 212$I_2$ so that water at temperature $T_{208}$ from the ice booster reservoir 208 can be selectively provided to the cold tank 206 to chill the water in the cold tank 206 to lower the temperature $T_{204}$ of the water dispensed from the cold water delivery system 200 to at least the desired drinking temperature $T_d$. When cold tank 206 is again able to exclusively satisfy the demand for water at the desired drinking temperature $T_d$, control system 216 directs mixing valve 212 to close port 212$I_2$ and to open port 212$I_1$.

Other configurations of the cold water delivery system 200 are possible. For example, when the temperature $T_{202}$ of the water at inlet 202 is closer to the desired drinking temperature $T_d$ (e.g., near 55° F.), control system 216 can direct mixing valve 214 to further open port 214$I_2$ and to further close port 214$I_1$ so that the system 200 uses a higher proportion of water directly from inlet 202 in addition to the chilled water from cold tank 206. In this manner, the efficiency of system 200 may be improved.

Figure 3:
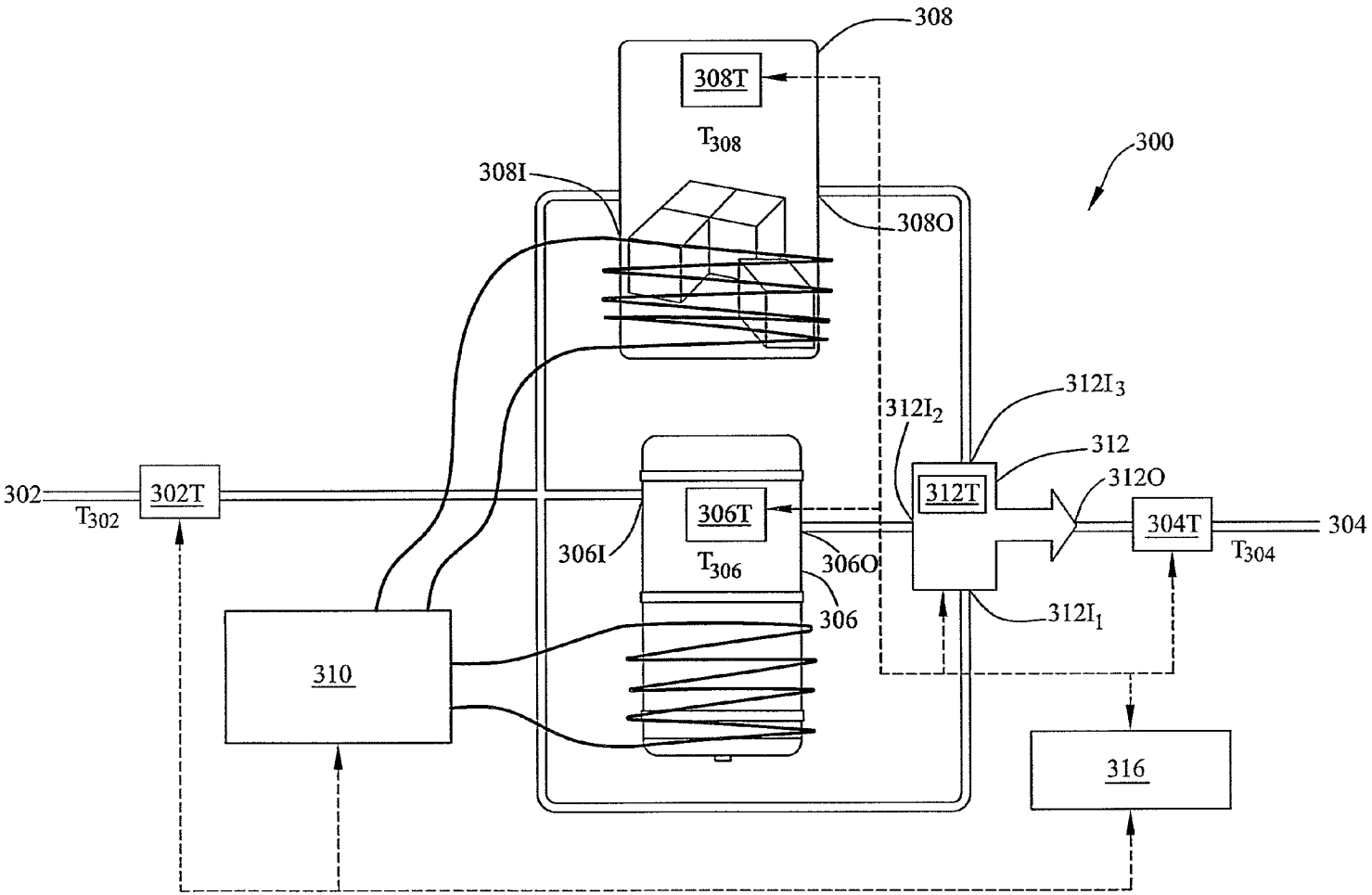
FIG. 3 is a diagrammatic view of a second embodiment of a cold water delivery system.

FIG. 3 shows another embodiment of a cold water delivery system 300 according to the disclosure. Many of the components of the system 300 of FIG. 3 are similar or identical to the components of the system 200 of FIG. 2, but the embodiment of FIG. 3 has a different water flow path and uses only one mixing valve. Water at temperature $T_{302}$ from the water inlet 302 can fill the cold tank 306 and the ice booster reservoir 308. In addition, water at temperature $T_{302}$ from the water inlet 302 can also enter port 312$I_1$ of the mixing valve 312. Water at temperature $T_{306}$ from the cold tank 306 can enter port 312$I_2$ of the mixing valve 312. However, unlike the embodiment of FIG. 2, water at temperature $T_{308}$ from the ice booster reservoir 308, which is well below the temperature $T_{306}$ of the water in the cold tank 306, can directly enter port $312I_3$ of the mixing valve 312. Thus, instead of the ice booster reservoir 308 recharging the cold tank 306, the water from the ice booster reservoir 308 can be mixed with water from the cold tank 306 and/or water from the water inlet 302 at the mixing valve 312 to keep up with the demand for water within a desired temperature range at the outlet 304. Temperature measurements can be taken by temperature sensors at suitable positions within the system 300, such as by temperature sensor 302T at the inlet 302, temperature sensor 304T at the outlet 304, temperature sensor 306T in the cold tank 306, temperature sensor 308T in the ice booster reservoir 308, and temperature sensor 312T at the mixing valve 312, to manage the cooling system 300 and outlet water temperature $T_{304}$.

Using temperature measurements, the control system 316 can dynamically control the mixing valve 312 to ensure that the water flowing from the outlet 304 of the system 300 is at or near a desired drinking temperature $T_d$. For example, the control system 316 can adjust the valve 312 to proportion the water from ports $312I_1$, $312I_2$, $312I_3$ to provide water exiting the system 300 at outlet 304 at a temperature $T_{304}$ at or near the desired drinking temperature $T_d$. It will be appreciated that the control system 316 can open and close, partially or fully, the ports in the mixing valve 312 in any suitable manner to maintain a relatively steady output of cold water within a desired temperature range at the outlet 304 of the cold water delivery system 300.

In an exemplary scenario, the temperature $T_{302}$ of the water at inlet 302 can be approximately 70° F., the ambient temperature in which the cold water delivery system 300 is located can be approximately 75° F., and the predetermined threshold temperature $T_t$ can be 55° F. Cold tank 306 is supplied with water of temperature $T_{302}$ from inlet 302, which it chills to a temperature $T_{306}$ and then provides to mixing valve 312 via port 306O. Control system 316 initially directs mixing valve 312 to open ports $312I_1$, $312I_2$, and 312O and to close port $312I_3$, and water at temperature $T_{304}$ is then dispensed from the cold water delivery system 300. Initially, the temperature $T_{304}$ of the dispensed water is equal to or below the desired drinking temperature $T_d$. In this configuration, the cold water delivery system 300 outputs water received from both cold tank 306 and directly from inlet 302.

However, when the system 300 experiences frequent and/or relatively large water draws, the temperature $T_{306}$ of the water in cold tank 306 may rise above the predetermined threshold temperature $T_t$ (i.e., the temperature $T_{306}$ of the water in cold tank 306 may rise to, for example, 56° F. or higher). When the temperature $T_{306}$ of the water in cold tank 306 rises above the predetermined threshold temperature $T_t$, the temperature $T_{304}$ of the water dispensed from the cold water delivery system 300 may rise above the desired drinking temperature $T_d$. When this occurs, control system 316 directs mixing valve 312 to close port $312I_1$ and to open port $312I_3$ so that water at temperature $T_{308}$ from the ice booster reservoir 308 can be selectively provided to the mixing valve 312 to lower the temperature $T_{304}$ of the water dispensed from the cold water delivery system 300 to at least the desired drinking temperature $T_d$. When cold tank 306 is again able to satisfy the demand for water at the desired drinking temperature $T_d$, control system 316 directs mixing valve 312 to close port $312I_3$ and to open port $312I_1$.

Other configurations of the cold water delivery system 300 are possible. For example, when the temperature $T_{302}$ of the water at inlet 302 is closer to the desired drinking temperature $T_d$ (e.g., near 55° F.), control system 316 can direct mixing valve 312 to further open port $312I_1$ and to further close port $312I_2$ so that the system 300 uses a higher proportion of water directly from inlet 302 in addition to the chilled water from cold tank 306. In this manner, the efficiency of system 300 may be improved.

Figure 4:
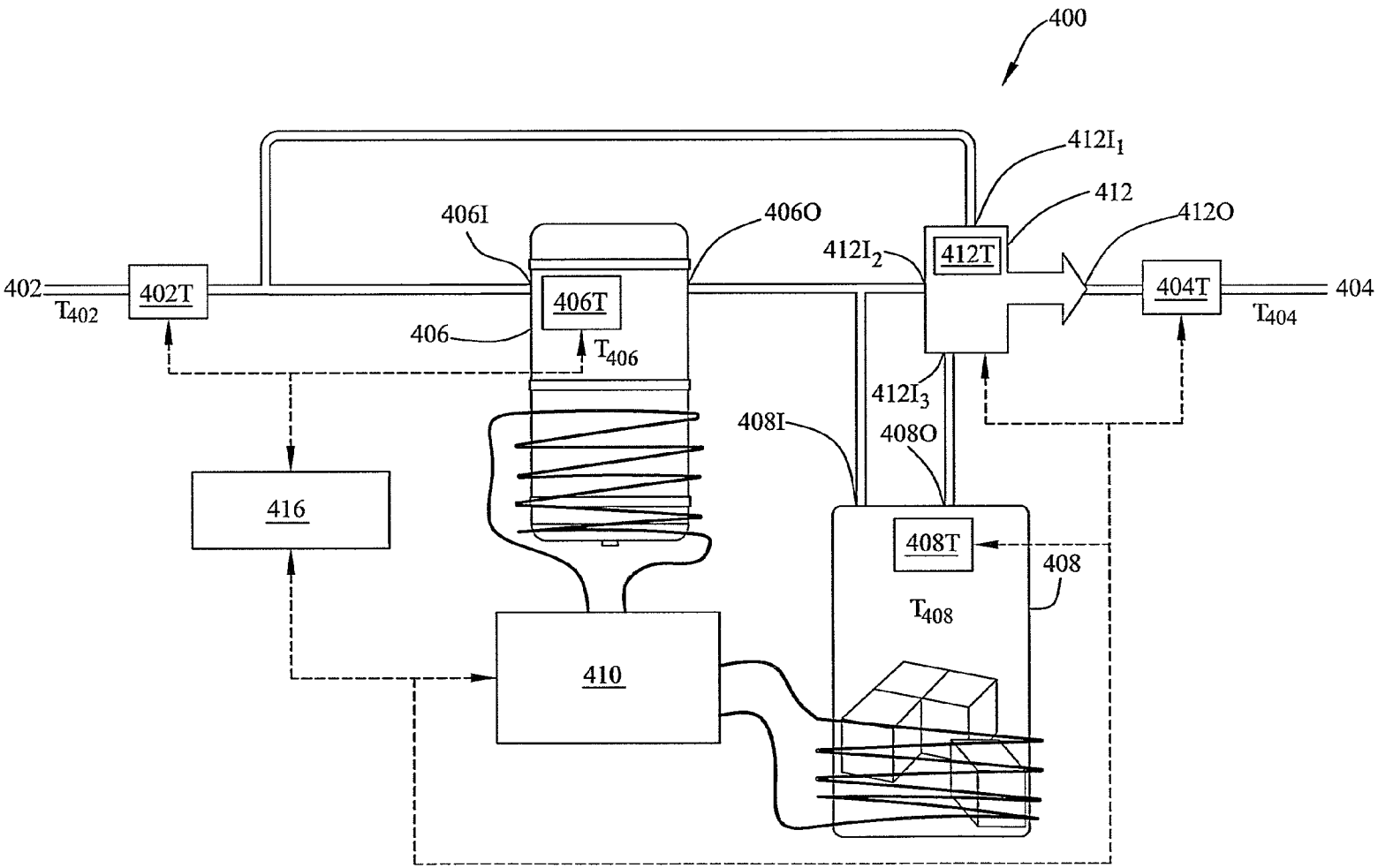
FIG. 4 is a diagrammatic view of a third embodiment of a cold water delivery system.

FIG. 4 shows a further embodiment of a cold water delivery system 400 according to the disclosure. Many of the components of the system 400 of FIG. 4 are similar or identical to the components of the systems 200, 300 of FIGS. 2 and 3, but the embodiment of FIG. 4 has a different water flow path. Water from the water inlet 402 can be received in the cold tank 406 at port 406I, where the temperature of the water can be reduced. Water at temperature $T_{406}$ can be dispensed from cold tank 406 at port 406O and then enter port $412I_2$ of the mixing valve 412. Unlike the embodiments of FIGS. 2 and 3, the water from the cold tank 406 can also enter and replenish the ice booster reservoir 408. Thus, the cold tank 406 can pre-chill the water to a temperature $T_{406}$ that is lower than the temperature $T_{402}$ of the water from inlet 402 before the water enters the ice booster reservoir 408. Temperature measurements can be taken by temperature sensors at suitable positions within the system 400, such as by temperature sensor 402T at the inlet 402, temperature sensor 404T at the outlet 404, temperature sensor 406T in the cold tank 406, temperature sensor 408T in the ice booster reservoir 408, and temperature sensor 412T at the mixing valve 412, to manage the cooling system 400 and outlet water temperature $T_{404}$.

Using temperature measurements, the control system 400 can dynamically control the mixing valve 412 to ensure that the water exiting the outlet 404 of the system 400 is at or near a desired drinking temperature $T_d$. For example, the control system 400 can adjust the valve 412 to proportion the water from ports $412I_1$, $412I_2$, $412I_3$ to provide water exiting the system 400 at outlet 404 at or near the desired drinking temperature $T_d$. It will be appreciated that the control system 416 can open and close, partially or fully, the ports in mixing valve 412 in any suitable manner to maintain a relatively steady output of cold water within a desired temperature range at the outlet 404 of the cold water delivery system 400.

In an exemplary scenario, the temperature $T_{402}$ of the water at inlet 402 can be approximately 70° F., the ambient temperature in which the cold water delivery system 400 is located can be approximately 75° F., and the predetermined threshold temperature $T_t$ can be 55° F. Cold tank 406 is then supplied with water of temperature $T_{402}$ from inlet 402, which it chills to a temperature $T_{406}$ and then provides to mixing valve 412 and to ice booster reservoir 408 via port 406O. Control system 416 initially directs mixing valve 412 to open ports $412I_1$, $412I_2$, and 412O and to close port $412I_3$, and water at temperature $T_{404}$ is then dispensed from the cold water delivery system 400. Initially, the temperature $T_{404}$ of the dispensed water is equal to or below the desired drinking temperature $T_d$. In this configuration, the cold water delivery system 400 outputs water that is received from both cold tank 406 and directly from inlet 402.

However, when the system 400 experiences frequent and/or relatively large water draws, the temperature $T_{406}$ of the water in cold tank 406 may rise above the predetermined threshold temperature $T_t$ (i.e., the temperature $T_{406}$ of the water in cold tank 406 may rise to, for example, 56° F. or higher). When the temperature $T_{406}$ of the water in cold tank 406 rises above the predetermined threshold temperature $T_t$, the temperature $T_{404}$ of the water dispensed from the cold water delivery system 400 may rise above the desired drinking temperature $T_d$. When this occurs, control system 416 directs mixing valve 412 to close port $412I_2$ and to open port $412I_3$ so that water at temperature $T_{408}$ from the ice booster reservoir 408 can be selectively provided to the mixing valve 412 to lower the temperature $T_{404}$ of the water dispensed from the cold water delivery system 400 to at least the desired drinking temperature $T_d$. When cold tank 406 is again able to satisfy the demand for water at the desired drinking temperature $T_d$, control system 416 directs mixing valve 412 to close port 412$I_3$ and to open port 412$I_2$.

Other configurations of the cold water delivery system 400 are possible. For example, when the temperature $T_{402}$ of the water at inlet 402 is closer to the desired drinking temperature $T_d$ (e.g., near 55° F.), control system 416 can direct mixing valve 412 to further open port 412$I_1$ and to further close port 412$I_2$ so that the system 400 uses a higher proportion of water directly from inlet 402 in addition to the chilled water from cold tank 406. In this manner, the efficiency of system 400 may be improved.

The cold water delivery system can be incorporated into any suitable apparatus. For example, the cold water delivery system can be incorporated into a bottle-type water cooler, a drinking fountain, a bottle filling water station, or a refrigerator water dispenser.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cold water delivery system comprising:

an inlet for receiving water at a first temperature;

an outlet for dispensing water;

a first reservoir fluidly connected to the inlet and the outlet, the first reservoir receiving water from the inlet and maintaining the water received therein from the inlet at a second temperature that is lower than the first temperature;

a second reservoir fluidly connected to the inlet and the outlet, the second reservoir maintaining the water received therein at a third temperature that is lower than the second temperature; and a mixing valve system, the mixing valve system having a first inlet port, a second inlet port, a third inlet port, and an outlet port, wherein the first inlet port is fluidly connected to the inlet for receiving water at the first temperature, the second inlet port is fluidly connected to the first reservoir for receiving water at the second temperature, the third inlet port is fluidly connected to the second reservoir for receiving water at the third temperature, and the outlet port is fluidly connected to the outlet, the mixing valve system receiving water from the first reservoir at the second temperature and water from the inlet at the first temperature, and further receiving water from the second reservoir at the third temperature, and configured for mixing water from the first, second and third temperatures when the water dispensed from the outlet rises above a predetermined threshold temperature;

wherein the mixing valve proportions the water dispensed from the outlet from amongst the water received from the first reservoir, the second reservoir, and the inlet at the first temperature to maintain the water dispensed from the outlet at or below the predetermined threshold temperature.

2. The cold water delivery system of claim 1 wherein the mixing valve blocks the flow of water from the inlet at the first temperature to the outlet.

3. The cold water delivery system of claim 1 wherein the mixing valve blocks the flow of water from the inlet at the first temperature to the outlet when water dispensed from the outlet rises above the predetermined threshold temperature.

4. The cold water delivery system of claim 1 wherein the mixing valve blocks the flow of water from the first reservoir to the outlet.

5. The cold water delivery system of claim 1 wherein the predetermined threshold temperature is approximately 55° F.

6. The cold water delivery system of claim 1 wherein the first temperature is approximately 70° F. or lower.

7. The cold water delivery system of claim 1 further comprising a plurality of temperature sensors for sensing the first temperature, the second temperature, the third temperature, and the temperature of the water dispensed from the outlet.

8. The cold water delivery system of claim 7 wherein the mixing valve proportions the water dispensed from the outlet from amongst the water received from the first reservoir, the second reservoir, and the inlet based upon the temperatures sensed by the plurality of the temperature sensors.

9. The cold water delivery system of claim 1, wherein the second reservoir receives water from the inlet at the first temperature.

10. The cold water delivery system of claim 9, further comprising a second mixing valve for directing water from the second reservoir into the first reservoir when water dispensed from the outlet rises above the predetermined threshold temperature.

11. The cold water delivery system of claim 10 wherein the second mixing valve blocks the flow of water from the inlet to the first reservoir when water dispensed from the outlet rises above the predetermined threshold temperature.

12. The cold water delivery system of claim 1, wherein the second reservoir receives water from the first reservoir.

13. The cold water delivery system of claim 12, wherein the mixing valve blocks water from the first reservoir from being dispensed at the outlet when water dispensed from the outlet rises above the predetermined threshold temperature.

14. The cold water delivery system of claim 1 further comprising a control system for determining the proportion of water to be dispensed by the mixing valve.

15. A method of dispensing cold water comprising:

receiving water at a first temperature from an inlet;

directing water from the inlet to a first reservoir fluidly connected to both the inlet and an outlet for dispensing water;

cooling the water in the first reservoir to a second temperature that is lower than the first temperature;

directing water to a second reservoir fluidly connected to the inlet and the outlet;

cooling the water in the second reservoir to a third temperature that is lower than the second temperature;

directing water from the first reservoir and the inlet at the first temperature to the outlet;

directing water from the second reservoir to the outlet when water dispensed from the outlet rises above a predetermined threshold temperature; and using a valve system having a first inlet connected to the inlet and receiving water at the first temperature, a second inlet connected to the first reservoir and water at the second temperature, and a third inlet connected to the second reservoir and receiving water at the third temperature; and proportioning the water dispensed from the outlet using the valve system from amongst the water received from the first reservoir, the second reservoir, and the inlet at the first temperature to maintain the water dispensed from the outlet at or below the predetermined threshold temperature.

16. The method of dispensing cold water of claim 15 further comprising blocking the flow of water from the inlet at the first temperature to the outlet.

17. The method of dispensing cold water of claim 16 further comprising blocking the flow of water from the inlet at the first temperature to the outlet when water dispensed from the outlet rises above the predetermined threshold temperature.

18. The method of dispensing cold water of claim 15 further comprising blocking the flow of water from the first reservoir to the outlet.

19. The method of dispensing cold water of claim 15 wherein the predetermined threshold temperature is approximately 55° F.

20. The method of dispensing cold water of claim 15 wherein the first temperature is approximately 70° F. or lower.

21. The method of dispensing cold water of claim 15 further comprising sensing the first temperature, the second temperature, the third temperature, and the temperature of the water dispensed from the outlet.

22. The method of dispensing cold water of claim 21 further comprising proportioning the water dispensed from the outlet from amongst the water received from the first reservoir, the second reservoir, and the inlet based upon the first temperature, the second temperature, the third temperature, and the temperature of the water dispensed from the outlet.

23. The method of dispensing cold water of claim 15 further comprising directing water from the inlet at the first temperature to the second reservoir.

24. The method of dispensing cold water of claim 23, further comprising directing water from the second reservoir into the first reservoir when water dispensed from the outlet rises above the predetermined threshold temperature.

25. The method of dispensing cold water of claim 24 further comprising blocking the flow of water from the inlet to the first reservoir when water dispensed from the outlet rises above the predetermined threshold temperature.

26. The method of dispensing cold water of claim 15 further comprising directing water from the first reservoir into the second reservoir.

27. The method of dispensing cold water of claim 26 further comprising blocking water from the first reservoir from being dispensed at the outlet when water dispensed from the outlet rises above the predetermined threshold temperature.

28. The method of dispensing cold water of claim 15 further comprising a control system for proportioning the water dispensed from the outlet from amongst the water received from the first reservoir, the second reservoir, and the inlet at the first temperature.

* * * * *